US005429312A

United States Patent [19]

Ohno et al.

[11] Patent Number: 5,429,312

[45] Date of Patent: Jul. 4, 1995

[54] ROLLER MILL

[75] Inventors: Yoshio Ohno; Kenichi Nakanishi, both of Takasago, Japan

[73] Assignee: Kabushiki Kaisha Kobe Seiko Sho, Kobe, Japan

[21] Appl. No.: 195,255

[22] Filed: Feb. 14, 1994

[30] Foreign Application Priority Data

Feb. 15, 1993 [JP] Japan ..... 5-025558
Dec. 28, 1993 [JP] Japan ..... 5-335219

[51] Int. Cl.[6] ..... B02C 25/00

[52] U.S. Cl. ..... 241/34; 241/65; 241/109; 241/DIG. 30; 198/533

[58] Field of Search ..... 241/33, 34, 65, 107, 241/109, 110, 111, 117–133, DIG. 30, 300; 198/493, 494, 495, 533

[56] References Cited

U.S. PATENT DOCUMENTS

| | | | |
|---|---|---|---|
| 1,397,657 | 11/1921 | Rasmussen | 198/533 X |
| 1,559,786 | 11/1925 | Sauer | 241/109 X |
| 2,453,006 | 11/1948 | Feight | 198/493 X |
| 2,614,682 | 10/1952 | Shand, Jr. | 198/533 |
| 2,658,603 | 11/1953 | Fernald | 241/DIG. 30 X |
| 4,597,537 | 7/1986 | Misaha et al. | 241/119 X |
| 4,869,434 | 9/1989 | Folsberg | 241/119 X |

FOREIGN PATENT DOCUMENTS

| | | | |
|---|---|---|---|
| 49103 | 3/1991 | Japan | 198/495 |
| 287878 | 3/1971 | U.S.S.R. | 198/533 |
| 899445 | 1/1982 | U.S.S.R. | 198/533 |
| 1602817 | 10/1990 | U.S.S.R. | 198/495 |

*Primary Examiner*—Timothy V. Eley
*Attorney, Agent, or Firm*—Oblon, Spivak, McClelland, Maier & Neustadt

[57] ABSTRACT

A side feed type of roller mill having a housing, a rotating table provided in the housing, and a feed inlet chute extending obliquely downwardly through an upper side wall of the housing and having a lower end exposed over the rotating table. The feed inlet chute includes a cylindrical chute body and a liner mounted inside the chute body. The liner is formed of a flexible elastic material, so that the inner surface of the liner is irregularly deformed as accompanying peristalsis and vibration by both the own weight and the gliding/falling forces of a feed material passing through the chute and the elastic restoring force of the liner itself. Accordingly, a deposit layer of the feed material formed on the inner surface of the liner can soon be autonomously removed by the deformation of the liner without interruption of the operation of the roller mill. Thus, stable and efficient pulverization can be continuously performed.

15 Claims, 8 Drawing Sheets

ROLLER MILL

BACKGROUND OF THE INVENTION

The present invention relates to a roller mill for pulverizing a feed material such as granulated slag, cement material, cement clinker, gypsum, or coal, and more particularly to a roller mill having a side feed type of feed inlet chute.

There are various types of pulverizers for pulverizing a feed material such as granulated slag, cement material, cement clinker, gypsum, or coal. Of the known various types of pulverizers, a roller mill has been widely used in recent years because of its pulverizing efficiency superior to that of a ball mill. While various types of roller mills exist, they are generally classified into a center feed type and a side feed type from the viewpoint of arrangement of a feed inlet chute.

An example of the center feed type of roller mill is shown in FIG. 7 in vertical section. As shown in FIG. 7, a feed inlet chute 70 extends vertically through an upper central portion of a housing 1. A feed material is supplied through the feed inlet chute 70 forming a vertical passage onto a rotating table 4 along its vertical axis of rotation.

On the other hand, an example of the side feed type of roller mill is shown in FIG. 8A in vertical section. As shown in FIG. 8A, a feed inlet chute 80 extends obliquely downwardly through an upper side wall of a housing 1 in such a manner that the lower end of the feed inlet chute 80 is exposed over a rotating table 4. A feed material is supplied through the feed inlet chute 80 forming an inclined passage onto the rotating table 4 along a line intersecting its vertical axis of rotation.

The general operation of these types of roller mills will be described with reference to FIGS. 7 and 8A. A feed material is supplied through the feed inlet chute 70 or 80 onto the rotating table 4 which is rotated about its vertical axis of rotation by a speed reducer 3 driven by a motor 2. The feed material supplied onto the rotating table 4 is moved to an outer peripheral portion of the rotating table 4 by a centrifugal force generated by the rotation of the rotating table 4. The feed material moved to the outer peripheral portion of the rotating table 4 is pulverized by a plurality of pulverizing rollers 5 rotating in pressure contact with the upper surface of the rotating table 4 at the outer peripheral portion thereof. Each pulverizing roller 5 is pressed on the upper surface of the rotating table 4 by a hydraulic cylinder 7 through a swing arm 6.

The feed material thus pulverized is raised by a heated gas flow injected from a plurality of injection nozzles 8 provided around the rotating table 4, and is then selectively separated by a separator 9 provided at an upper portion in the casing 1, so that fine powder having a given size or less obtained by pulverizing the feed material is allowed to pass through the separator 9 and is then ejected from an outlet opening 1a formed at an upper side portion of the casing 1. On the other hand, relatively coarse powder not allowed to pass through the separator 9 falls on the rotating table 4, and is subjected to pulverization again.

In general, however, the feed material to be pulverized by the roller mill mostly contains fine powder having a high viscosity, and sometimes contains moisture as in granulated slag. Accordingly, such fine powder of the feed material is deposited on the inner surface of the feed inlet chute during passage through the chute, resulting in the formation of a deposited layer of the fine powder strongly sticking to the inner surface of the chute. If this deposit layer is allowed to accumulate, it grows to narrow the passage of the chute through which the feed material can pass. As a result, normal supply of the feed material into the roller mill is hindered by the growth of the deposit layer. Finally, the passage of the chute is choked by the deposit layer resulting in the fatal condition that the feed material can no longer be supplied into the roller mill.

To cope with this problem, various cleaning devices for removing the deposit layer formed on the inner surface of the feed inlet chute at a suitable time have been proposed especially for the center feed type of roller mill. For example, there has been proposed in Japanese Patent Laid-open Publication Nos. 4-145958, 4-176344, and 4-200656 a cleaning device having a jig adapted to be moved vertically inside the vertical feed inlet chute for scraping off the deposit layer.

In the center feed type of roller mill, the feed inlet chute is vertically provided at the top of the housing of the roller mill. Accordingly, auxiliary facilities for carrying the feed material to a high position over the top of the housing become large in size. Further, it is necessary to concentrically arrange the feed inlet chute and the separator. Thus, the roller mill as a whole becomes very complicated in structure with the disadvantages such that the manufacturing cost for the roller mill as a whole, the number of man-hours for the checking and replacement of the feed inlet chute, etc. are high compared to those for the side feed type of roller mill.

The above-mentioned cleaning devices for the center feed type of roller mill as conventionally proposed have the following problems.

In the cleaning device described in Japanese Patent Laid-open Publication No. 4-145958, it is necessary to detach and attach the cleaning device every time the cleaning of the feed inlet chute is carried out. Further, in detaching and attaching the cleaning device and in actually cleaning the feed inlet chute, the operation of the roller mill must be stopped.

In the cleaning device described in Japanese Patent Laid-open Publication No. 4-176344, the cleaning device is always installed in the feed inlet chute in such a manner as not to hinder the pass of a feed material through the chute. Accordingly, it is unnecessary to detach and attach the cleaning device in carrying out the cleaning of the chute, and the chute can be cleaned without stopping the operation of the roller mill. However, when the chute is cleaned by the cleaning device, the fine powder of the feed material is deposited to the cleaning device, so that it is necessary to clean the cleaning device itself and stop the operation of the roller mill when carrying out the cleaning of the cleaning device. Further, the cleaning device cannot be stored outside the feed inlet chute during the operation of the roller mill. As a result, the cleaning device is always exposed to a flow of feed material in the chute, thus promoting the deposition of the feed material to the cleaning device.

In the cleaning device described in Japanese Patent Laid-open Publication No. 4-200656, the feed material chute has a two-way structure to form a space through which a feed material does not pass, so that the cleaning device is stored in this space at any time other than during the cleaning of the feed inlet chute, thereby greatly solving the above problem. However, there still remains the problem that the operation of the roller mill must be stopped when cleaning the cleaning device after the feed inlet chute has been cleaned by the cleaning device.

On the other hand, in the side feed type of roller mill, the deposition of a feed material on the inner surface of the feed inlet chute occurs more readily than that in the center feed type of roller mill, because the feed inlet chute is inclined. Further, since the feed material glides and falls along a circumferential bottom portion of the inner surface of the chute, the circumferential bottom portion in particular is prone to be partially worn.

To suppress the deposition of the feed material, an inclination angle of the feed inlet chute is set to be high in the conventional side feed type of roller mill. However, the enlargement of the inclination angle of the chute causes the problem that the lower end of the chute does not extend to the central portion of the roller mill. As a result, the feed material cannot be dropped on the center of the rotating table thus causing nonuniform supply of the feed material to each pulverizing roller, thus reducing the pulverizing efficiency.

As shown in FIG. 8B which is a cross section taken along the line A—A in FIG. 8A, the partial wear of the circumferential bottom portion of the inner surface of the chute as mentioned above can be prevented by mounting a liner 81 on the inner surface of the feed inlet chute 80 at a U-shaped bottom portion thereof. However, since the liner 81 is formed of ceramics having a high wear resistance or sheet steel with special hard facing, the manufacturing cost of the liner 81 is relatively high.

SUMMARY OF THE INVENTION

It is accordingly an object of the present invention to provide a roller mill having a side feed type of feed inlet chute which can be manufactured at low costs.

It is another object of the present invention to provide a roller mill having a side feed type of feed inlet chute which can easily and securely remove the deposit layer formed on the inner surface of the chute without interruption of operation of the roller mill.

It is a further object of the present invention to provide a roller mill having a side feed type of feed inlet chute which can stably supply a feed material over the central portion of the rotating table in the roller mill.

It is a still further object of the present invention to provide a roller mill having a side feed type of feed inlet chute which can continuously perform stable and efficient pulverization to thereby improve productivity.

According to the present invention, there is provided in a roller mill having a housing, a milling table adapted to be rotated about a vertical axis provided in said housing, a plurality of milling rollers provided in said housing and mounted so as to act against an outer portion of the upper surface of said milling table and a feed inlet chute extending obliquely through a side wall of said housing for supplying a feed material from outside the housing onto said milling table to be pulverized between said milling table and said milling rollers; wherein said feed inlet chute comprises a liner made of a flexible elastic material which is preferably mounted inside a chute body.

The liner may be mounted through a plurality of spacers to the chute body, so that a space is defined between the liner and the chute body.

The chute body may have means for forcibly deforming the liner.

The chute body may have liner deforming means adapted to be operated by a command from an external control unit to forcibly deform the liner and pressure detecting means for detecting pressure in the chute body to transmit the pressure detected to the external control unit.

Further, the chute body may have means for cooling the liner.

In the roller mill of the present invention, the feed inlet chute extending obliquely downwardly through the upper side wall of the housing and having the lower end exposed over the rotating table includes the cylindrical chute body and the liner mounted inside the chute body, and the liner is formed of a flexible elastic material. Accordingly, when a feed material is discharged into the feed inlet chute, the liner having a flexibility and elasticity is elastically deformed by weight and the gliding/falling forces of the feed material passing through the chute. The liner thus elastically deformed restores its original form through an elastic restoring force. Therefore, the inner surface of the liner generates irregular deformation accompanying peristalsis and vibration due to both the weight and the gliding/falling forces of the feed material and the elastic restoring force of the liner. Accordingly, even when a deposit layer of the feed material is formed on the inner surface of the liner of the chute, the deposit layer can soon be removed by the irregular deformation of the inner surface of the liner caused by the passage of the feed material through the chute, thus preventing the growth of the deposit layer.

In this manner, the removal of the deposit layer formed in the feed inlet chute can be autonomously attained by the deformation of the liner caused by the passage of the feed material through the feed inlet chute during the operation of the roller mill. Therefore, the removal of the deposit layer does not depend on a cleaner or the like moving in a feed inlet chute as in the conventional roller mill. Further, it is unnecessary to interrupt the operation of the roller mill, so as to perform the removal of the deposit layer. Thus, the growth of the deposit layer in the feed inlet chute can be prevented to make the passage of the feed material smooth and stable. Further, it is unnecessary to unduly largely incline the feed inlet chute for the purpose of suppressing the deposition of the feed material, and an inclination angle suitable for supplying the feed material to the central portion of the rotating table can be selected, thereby effecting efficient pulverization.

In the case where the liner is mounted through a plurality of spacers to the chute body, thereby defining a space between the liner and the chute body, the liner can be flexed by the weight and the gliding/falling forces of the feed material passing through the chute, thereby generating a larger deformation of the inner surface of the liner. Accordingly, the deposit layer on the inner surface of the liner can be removed more securely.

In the case where the chute body has means for forcibly deforming the liner, the liner can be deformed not only by the weight and the gliding/falling forces of the feed material, but also forcibly by the liner deforming means. Accordingly, the deposit layer on the inner surface of the liner can be removed more securely and easily.

The roller mill is usually operated in the condition where the inside of the housing is kept under a negative pressure or a positive pressure with respect to atmospheric pressure. Accordingly, when the deposition of the feed material on the inner surface of the feed inlet chute causes a reduction in sectional area of the passage of the chute, there results a difference in pressures between the upper and lower end portions of the chute body. Accordingly, in the case where the chute body has means adapted to be operated by a command from an external control unit to forcibly deform the liner and means for detecting pressure in the chute body to transmit the pressure detected to the external control unit, a change in pressure in the chute body is transmitted to the external control unit, and the liner deforming means is operated according to the change in pressure, thereby always maintaining a good condition where the growth of the deposit layer on the inner surface of the liner is eliminated.

Further, in the case where the chute body has means for cooling the liner, a temperature rise of the liner due to hot air introduced into the roller mill can be suppressed to thereby prevent material deterioration of the liner due to any temperature rise.

Other objects and features of the invention will be more fully understood from the following detailed description and appended claims when taken with the accompanying drawings.

DETAILED DESCRIPTION OF THE PREFERRED EMBODIMENTS

Figure 1A:
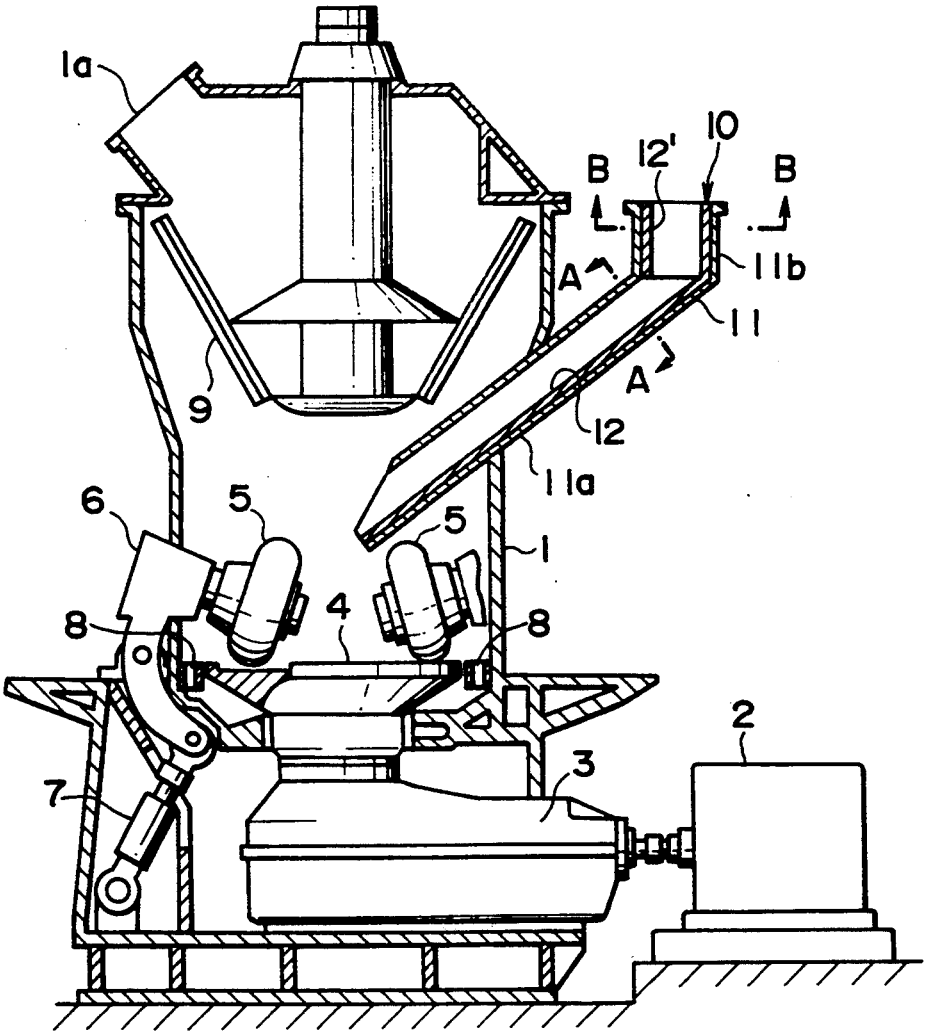
FIG. 1A is a vertical sectional view of a roller mill according to a first preferred embodiment of the present invention.
Figure 1B:
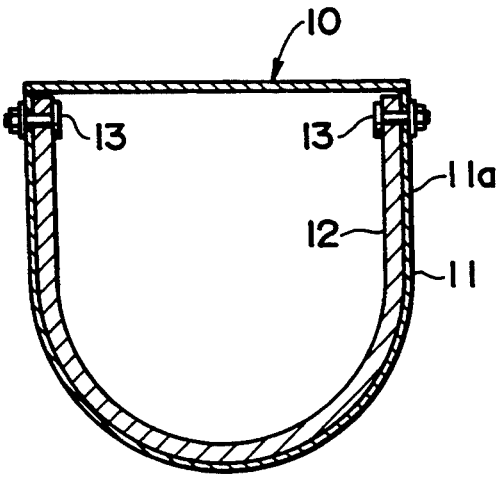
Fig. 1B is a cross section taken along the line A—A in FIG. 1A.
Figure 1C:
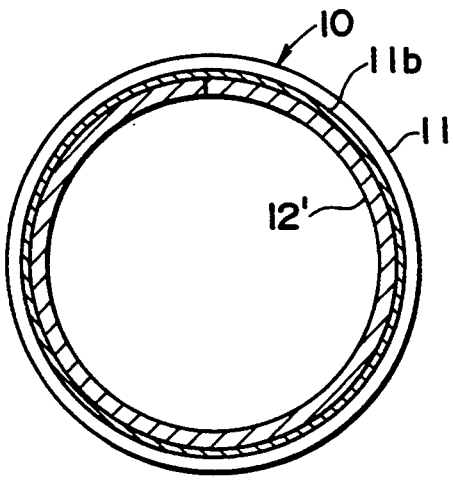
FIG. 1C is a cross section taken along the line B—B in FIG. 1A.
Figure 8A:
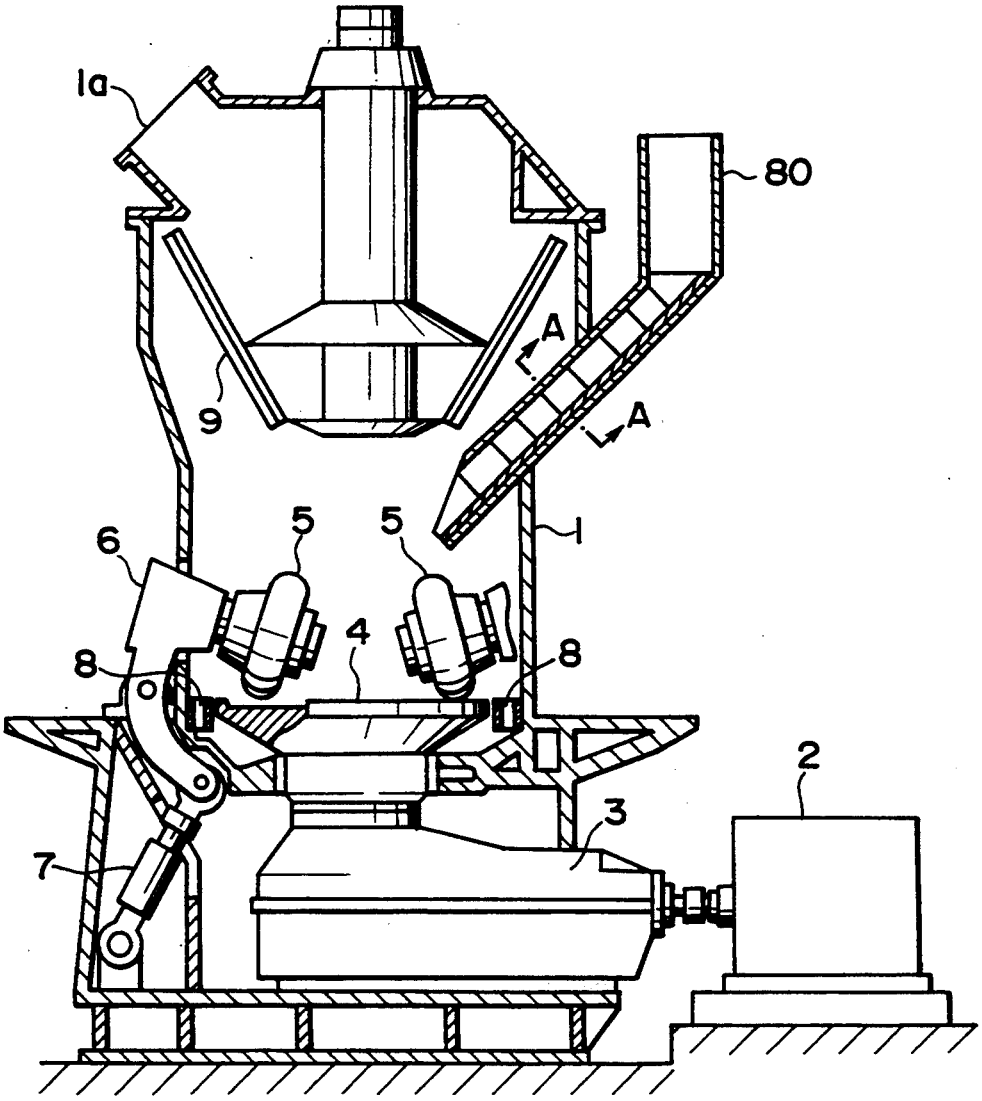
FIG. 8A PRIOR ART
FIG. 8A is a vertical sectional view of a side feed type of roller mill in the prior art.
Figure 8B:
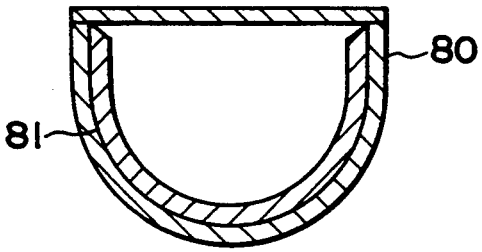
FIG. 8B PRIOR ART
FIG. 8B is a cross section taken along the line A—A in FIG. 8A.

A first preferred embodiment of the present invention will now be described with reference to FIGS. 1A to 1C, wherein FIG. 1A is a vertical sectional view of a roller mill as a whole; FIG. 1B is a cross section taken along the line A—A in FIG. 1A; and FIG. 1C is a cross section taken along the line B—B in FIG. 1A. In FIGS. 1A to 1C, the same reference numerals as those shown in FIGS. 8A and 8B denote the same parts, and the explanation thereof will be omitted hereinafter.

Referring to FIGS. 1A to 1C, reference numeral 10 denotes a feed inlet chute. The feed inlet chute 10 is of a side feed type such that is includes a cylindrical chute body 11 passing obliquely downwardly through an upper side wall of a housing 1 and having a lower end exposed over a central portion of a rotating table 4, and also includes liners 12 and 12' mounted on the inner surface of the chute body 11. The chute body 11 is formed of sheet steel, and the liners 12 and 12' are formed of sheet rubber. Although not shown, an air seal mechanism for maintaining a negative pressure in the roller mill is connected to the upper end of the feed inlet chute 10.

The chute body 11 is composed of a relatively long inclined portion **11*a* and a relatively short upright portion 11*b* continuously connected to the upper end of the inclined portion 11*a*. As apparent from FIG. 1B, the inclined portion 11*a* has a U-shaped cross section such that the top side is formed as a flat lid and the bottom side is curved to form an arc shape. The inclined portion 11*a* passes through the upper side wall of the housing 1, and is detachably mounted thereto. As apparent from FIG. 1C, the upright portion 11*b*** has a circular cross section.

As shown in FIG. 1B, the liner 12 has a U-shaped cross section so that it is closely fitted with the whole U-shaped inner surface of the inclined portion **11*a* of the chute body 11 except the top flat lid. The liner 12 is detachably connected at its opposite side edges to the inclined portion 11*a* by a plurality of fasteners 13 over the length of the inclined portion 11*a*. The liner 12 has a relatively large thickness. As shown in FIG. 1C, the liner 12' has a circular cross section so that it is attached to the whole circular cylindrical inner surface of the upright portion 11*b* of the chute body 11**.

In the roller mill having the above structure, a feed material discharged into the feed inlet chute 10 glides and falls along the liners 12 and 12' mounted on the inner surface of the chute body 11. During the passage of the feed material through the feed inlet chute 10, the liners 12 and 12' formed of a rubber material as a flexible elastic material are elastically deformed by the weight of the feed material and the gliding/falling forces of the feed material. As the liners 12 and 12' thus elastically deformed restore their original forms through an elastic restoring force, the inner surfaces of the liners 12 and 12' generate irregular deformation accompanying peristalsis and vibration due to both the weight and the gliding/falling forces of the feed material passing through the feed inlet chute 10 and the elastic restoring force of the liners 12 and 12'.

Accordingly, even when the feed material to be pulverized contains fine powder having a high viscosity, and a deposit layer of the fine powder is formed on the inner surfaces of the liners 12 and 12' during the pass of the feed material through the material inlet chute 10, the deposit layer can soon be removed from the inner surfaces of the liners 12 and 12' by the irregular deformation accompanying peristalsis and vibration mentioned above, thereby preventing the growth of the deposit layer.

In this manner, the removal of the deposit layer formed in the feed inlet chute can be autonomously attained by the deformation of the liners occurring during the passage of the feed material through the feed inlet chute during the operation of the roller mill. Therefore, the removal of the deposit layer does not depend on a cleaner or the like moving in a feed inlet chute as in the conventional roller mill. Further, it is unnecessary to interrupt the operation of the roller mill, so as to perform the removal of the deposit layer. Thus, the growth of the deposit layer in the feed inlet chute can be prevented to make the passage of the feed material smooth and stable. Further, it is unnecessary to unduly largely incline the feed inlet chute for the purpose of suppressing the deposition of the feed material, and an inclination angle suitable for supplying the feed material to the central portion of the rotating table can be selected, thereby effecting efficient pulverization.

Further, the liner formed of a natural or synthetic rubber material is much more economical than the ceramic liner or the steel liner with a special hard facing of the prior art.

Subsequently, second to fourth preferred embodiments of the present invention will be described. The second to fourth preferred embodiments are similar to the first preferred embodiment but different in the manner of the mounting of the liners in the feed inlet chute and a partial construction of the chute body. Therefore, only an essential part primarily including the feed inlet chute is shown in each of the second to fourth preferred embodiments. Further, the parts equivalent to those shown in FIGS. 1A to 1C are denoted by the same reference numerals with the explanation thereof omitted, and only different parts will be essentially described.

Figure 2A:
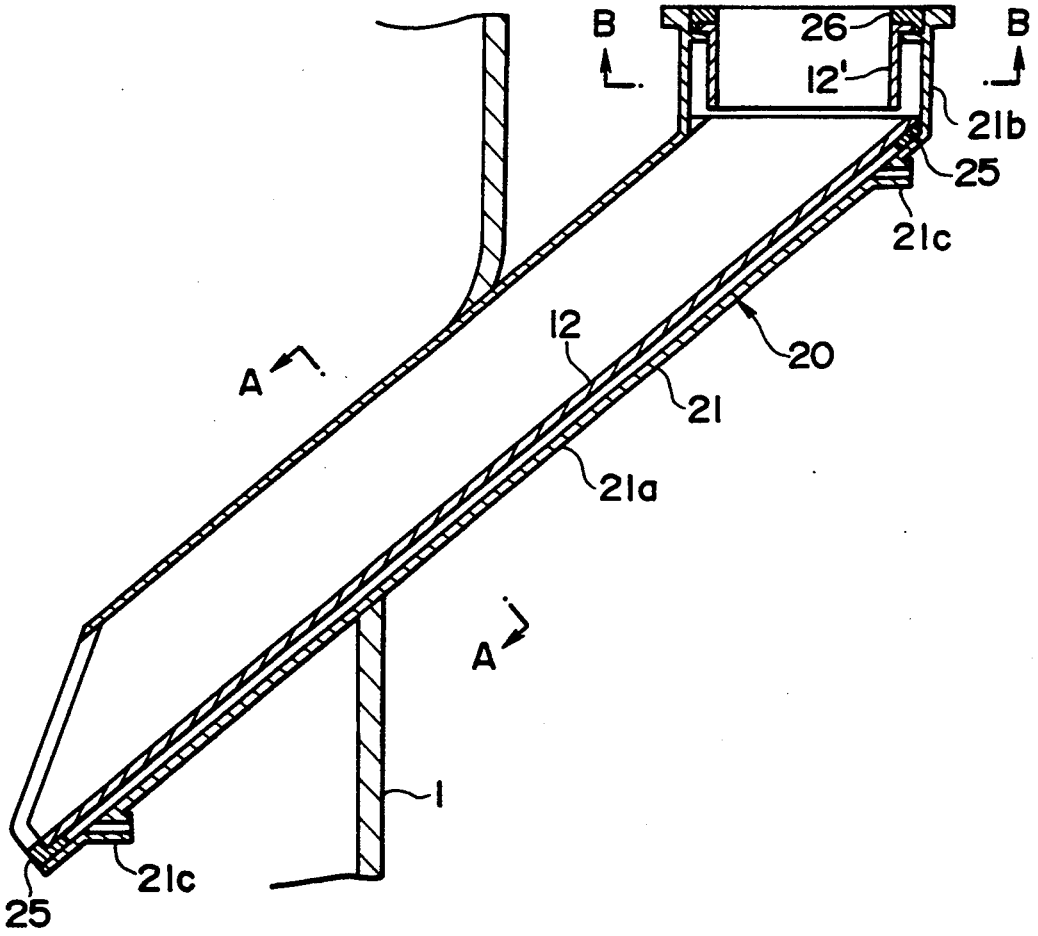
FIG. 2A is a vertical sectional view of an essential part of a roller mill according to a second preferred embodiment of the present invention.
Figure 2B:
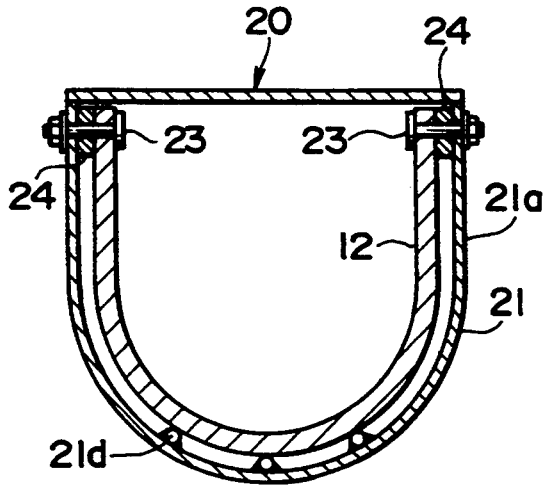
FIG. 2B is a cross section taken along the line A—A in FIG. 2A.
Figure 2C:
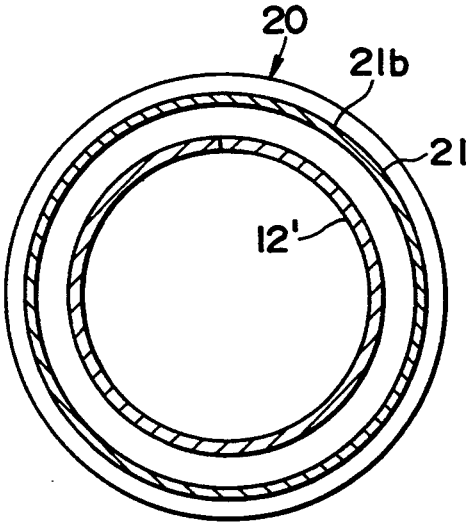
FIG. 2C is a cross section taken along the line B—B in FIG. 2A.

The essential part of a roller mill according to the second preferred embodiment is shown in FIGS. 2A to 2C, wherein FIG. 2A is a vertical sectional view of the essential part; FIG. 2B is a cross section taken along the line A—A in FIG. 2A; and FIG. 2C is a cross section taken along the line B—B in FIG. 2A.

As shown in FIG. 2A, a feed inlet chute 20 is of a side feed type similar to that in the first preferred embodiment. As shown in FIG. 2B, a U-shaped liner 12 provided inside an inclined portion 21*a* of a chute body 21 is uniformly spaced from the U-shaped inner surface of the chute body 21 except a top flat lid thereof. The liner 12 is detachably connected at its opposite side edges through a pair of elongated spacers 24 to the inclined portion 21*a* by a plurality of fasteners 23. The spacers 24 extend over the length of the inclined portion 21*a*.

As shown in FIG. 2A, the upper and lower ends of the liner 12 are connected through a pair of seal members 25 to the inclined portion 21*a*. Thus, the space between the liner 12 and the inclined portion 21*a* is sealed by the spacers 24 and the seal members 25.

Further, a pair of air vents 21*c* are provided at the upper and lower portions of the inclined portion 21*a* so as to communicate with the sealed space between the liner 12 and the inclined portion 21*a*. The air vents 21*c* are connected through pipes (not shown) to an external air supply device (not shown). With this structure, fine powder contained in a feed material is prevented from entering the space between the liner 12 and the inclined portion 21*a* of the chute body 21. Furthermore, a cooling air is supplied from the air supply device into this space to cool the liner 12, thereby preventing the liner 12 from being deteriorated by its temperature rise due to hot air introduced into the roller mill.

As shown in FIGS. 2A and 2C, a circular cylindrical liner 12' provided inside an upright portion 21*b* of the chute body 21 is retained through an annular spacer 26 to the upright portion 21*b* in such a manner as to be suspended from the upper end of the upright portion 21*b* with an annular space defined between the liner 12' and the upright portion 21*b*. The wall thickness of the liner 12' inside the upright portion 21*b* is smaller than that of the liner 12 inside the inclined portion 21*a*.

Further, as shown in FIG. 2B, three projections 21*d* serving as spacers are welded to the inner surface of the inclined portion 21*a* at the bottom portion thereof. The projections 21*d* are formed as steel rods extending in parallel over the length of the inclined portion 21*a*.

In the second preferred embodiment mentioned above, a space is defined between the liner 12 and the inclined portion 21*a* of the chute body 21, and a space is defined between the liner 12' and the upright portion 21*b* of the chute body 21. In other words, the liners 12 and 12' are not directly backed up by the chute body 20 unlike the first preferred embodiment. Accordingly, the liners 12 and 12' can be elastically deformed more than those in the first preferred embodiment by the weight and the gliding/falling forces of the feed material passing through the feed inlet chute 20. As a result, the amplitude of return motion by the elastic restoring force of the liners 12 and 12' can be increased to thereby generate irregular deformation accompanying peristalsis and vibration having a large amplitude on the inner surfaces of the liners 12 and 12'. Thus, a deposit layer of fine powder on the inner surfaces of the liners 12 and 12' can be removed more securely.

The provision of the three spacer projections 21*d* on the inner surface of the inclined portion 21*a* at the bottom portion thereof is intended to prevent that the liner 12 deformed by the feed material passing through the chute 20 will come into close contact with the inner surface of the inclined portion 21*a* at the bottom portion thereof in a wide range to generate regular deformation on the inner surface in this range. However, if the distance between the liner 12 and the inclined portion 21*a* is set large enough, the spacer projections 21*d* may be eliminated.

Figure 3A:
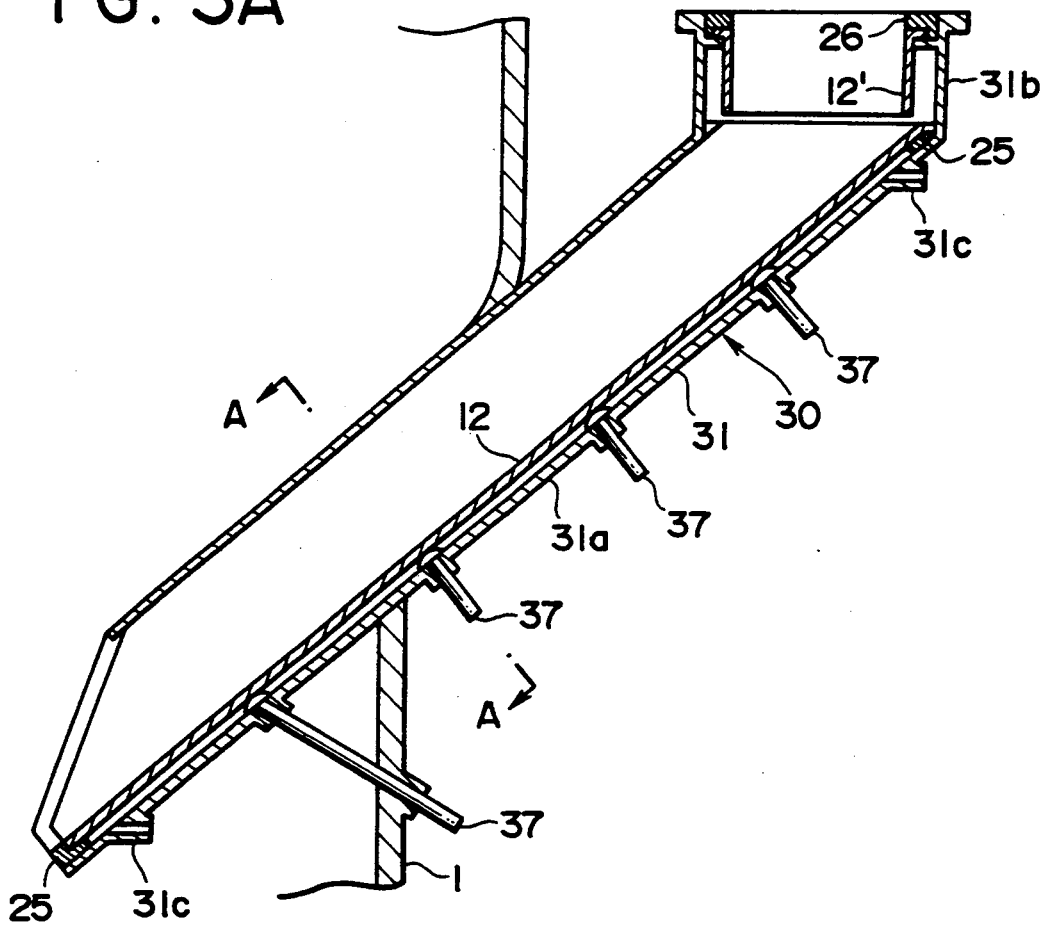
FIG. 3A is a vertical sectional view of an essential part of a roller mill according to a third preferred embodiment of the present invention.
Figure 3B:
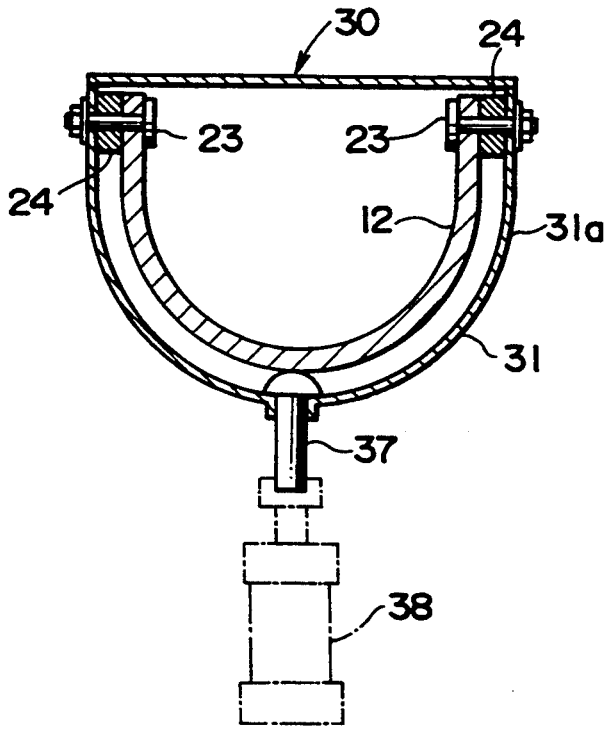
FIG. 3B is a cross section taken along the line A—A in FIG. 3A.

The essential part of a roller mill according to the third preferred embodiment is shown in FIGS. 3A and 3B, wherein FIG. 3A is a vertical sectional view of the essential part; and FIG. 3B is a cross section taken along the line A—A in FIG. 3A.

As shown in FIG. 3A, a feed inlet chute 30 is of a side feed type similar to that in the first preferred embodiment. As similar to the second preferred embodiment, a U-shaped liner 12 provided inside an inclined portion 31*a* of a chute body 31 is spaced from the U-shaped inner surface of the inclined portion 31*a*, and a circular cylindrical liner 12' provided inside an upright portion 31*b* of the chute body 31 is spaced from the circular cylindrical inner surface of the upright portion 31*b*. Further, as also similar to the second preferred embodiment, a pair of air vents 31*c* are provided at the upper and lower portions of the inclined portion 31*a*.

As shown in FIG. 3A, a plurality of push rods 37 are provided so as to extend through the wall of the inclined portion 31*a*. The push rods 37 are spaced at a given pitch in a longitudinal direction of the inclined portion 31*a*. As shown in FIG. 3B, each push rod 37 is located at the bottom of the inclined portion 31*a* in its circumferential direction, and has a semi-spherical end adapted to push the outer surface of the liner 12. Each push rod 37 may be retractably pushed manually in a direct fashion by using a hammer or the like or in a remote fashion by using a driving means such as a cylinder 38 (shown by a phantom line in FIG. 3B) or a vibrator connected to the outer end of each push rod 37. As apparent from FIG. 3B, no spacer projections as used in the second preferred embodiment are provided on the inner surface of the inclined portion 31*a* of the chute body 31.

In the third preferred embodiment mentioned above, as similar to the second preferred embodiment, irregular deformation accompanying peristalsis and vibration having a large amplitude can be generated on the inner surfaces of the liners 12 and 12' by the weight and the gliding/falling forces of the feed material passing through the feed inlet chute 30. Moreover, the liner 12 can be forcibly deformed at an arbitrary timing by advancing and retracting each push rod 37. Thus, a deposit layer on the inner surfaces of the liners 12 and 12' can be removed more securely and easily.

Additionally, similar to the second preferred embodiment, cooling air may be supplied to the space between the liner 12 and the inclined portion 31*a* of the chute body 31 to thereby cool the liner 12.

Figure 4A:
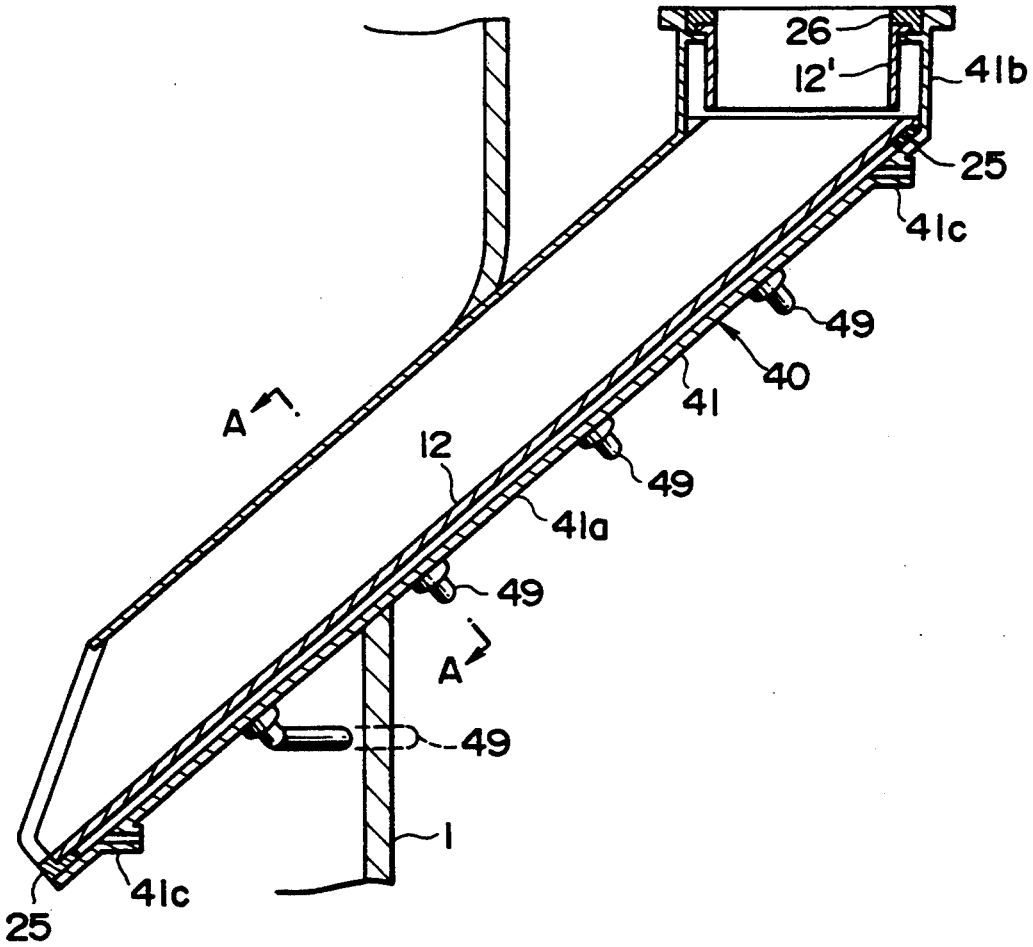
FIG. 4A is a vertical sectional view of an essential part of a roller mill according to a fourth preferred embodiment of the present invention.
Figure 4B:
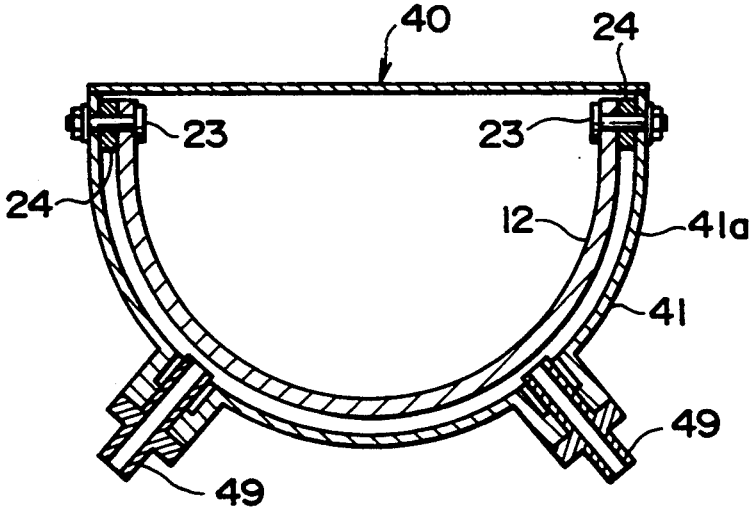
FIG. 4B is a cross section taken along the line A—A in FIG. 4A.

The essential part of a roller mill according to the fourth preferred embodiment is shown in FIGS. 4A and 4B, wherein FIG. 4A is a vertical sectional view of the essential part, and FIG. 4B is a cross section taken along the line A—A in FIG. 4A.

As shown in FIG. 4A, a feed inlet chute 40 is of a side feed type similar to that in the first preferred embodiment. As similar to the second and third preferred embodiments, a liner 12 provided inside an inclined portion 41*a* of a chute body 41 is spaced from the inner surface of the inclined portion 41*a*, and a liner 12' provided inside an upright portion 41*b* of the chute body 41 is spaced from the inner surface of the upright portion 31*b*. Further, similar to the second and third preferred embodiments, a pair of air vents 41*c* are provided at the upper and lower portions of the inclined portion 41*a*.

As shown in FIG. 4A, a plurality of air injection pipes 49 are provided so as to extend through the wall of the inclined portion 41*a*. The air injection pipes 49 are spaced at a given pitch in a longitudinal direction of the inclined portion 41*a*. As shown in FIG. 4B, the air injection pipes 49 are arranged in two parallel lines spaced in a circumferential direction of the inclined portion 41*a* at the bottom portion thereof. Each air injection pipe 49 has a nozzle opening directed to the inner surface of the liner 12 in close relationship thereto. Although not shown, the air injection pipes 49 are connected through pipes to a compressed air supply device, so that a pulsating compressed air supplied from the compressed air supply device is injected to the inner surface of the liner 12.

In the fourth preferred embodiment mentioned above, as similar to the second preferred embodiment, irregular deformation accompanying peristalsis and vibration having a large amplitude can be generated on the inner surfaces of the liners 12 and 12' by the weight and the gliding/falling forces of the feed material passing through the feed inlet chute 40. Moreover, the liner 12 can be forcibly deformed at an arbitrary timing by injecting a pulsating compressed air from each air injection pipe 49. Thus, a deposit layer on the inner surfaces of the liners 12 and 12' can be removed more securely and easily.

Additionally, the air injected from each air injection pipe 49 is expelled from the air vents 41*c* to thereby produce an air flow in the space between the liner 12 and the inclined portion 41*a*, thus cooling the liner 12.

Figure 5:
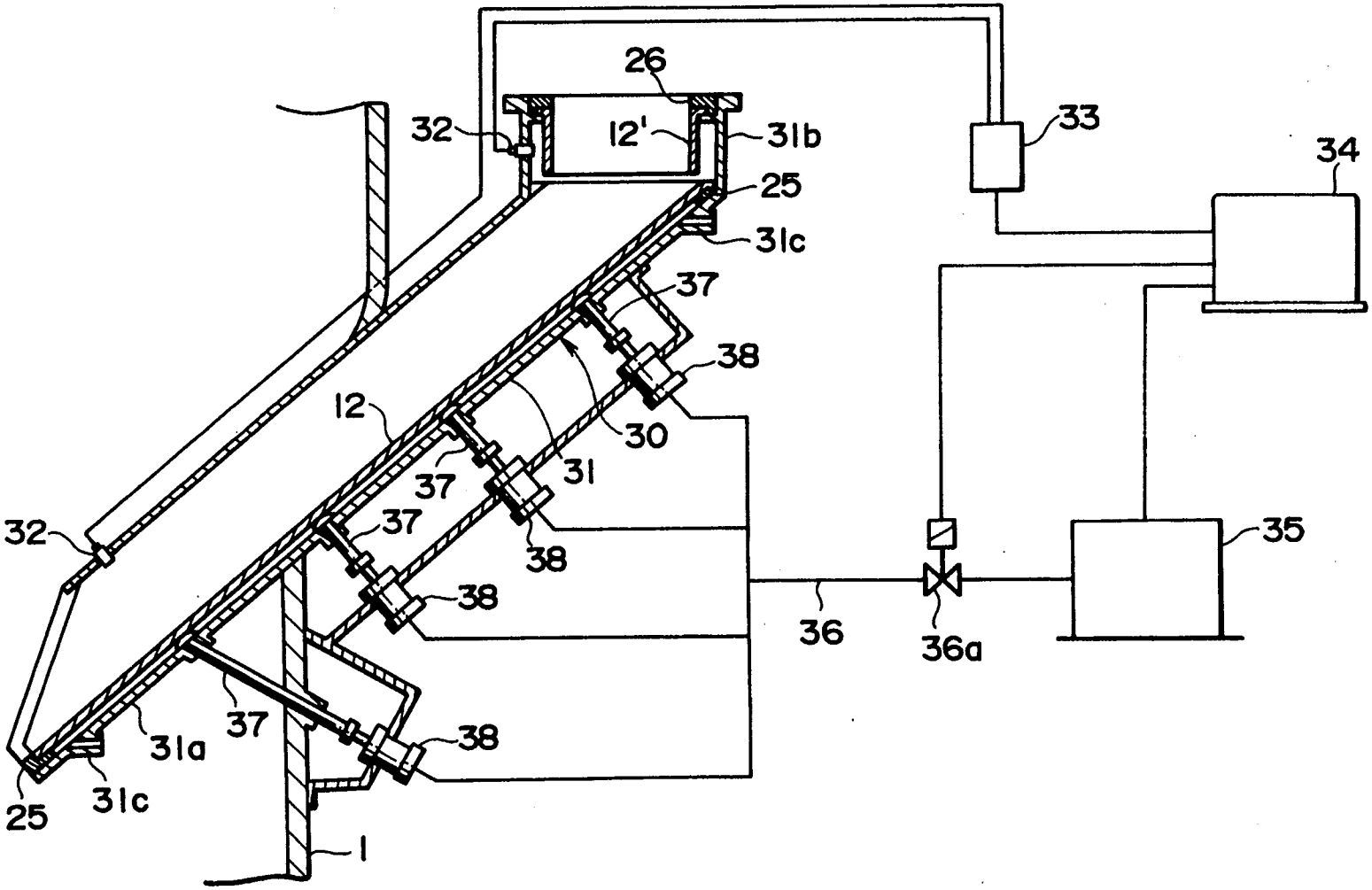
FIG. 5 is a vertical sectional view of an essential part of a roller mill and an operation control system therefor according to a fifth preferred embodiment of the present invention.

A fifth preferred embodiment of the present invention will now be described with reference to FIG. 5, which shows an essential part of a roller mill and its operation control system according to the fifth preferred embodiment. The fifth preferred embodiment is similar to the third preferred embodiment except for the addition of an operation control system for controlling the operation of a feed inlet chute. Therefore, only an essential part primarily including the feed inlet chute and the operation control system is shown in FIG. 5. Further, the parts equivalent to those shown in FIGS. 3A and 3B are denoted by the same reference numerals with the explanation thereof omitted, and only different parts will be essentially described.

Referring to FIG. 5, reference numeral 30 denotes a feed inlet chute having a plurality of push rods 37 similar to those shown in FIGS. 3A and 3B. A plurality of cylinders 38 are connected to the outer ends of the push rods 37, respectively, so as to advance and retract the push rods 37, thereby forcibly deforming a liner 12. Each cylinder 38 is connected through a pipe 36 to a compressed air supply device 35, so that each cylinder 38 is operated by compressed air supplied from the compressed air supply device 35. A closing valve 36*a* is provided in the pipe 36. The closing valve 36*a* is operated by a command from a main control panel 34. The compressed air supply device 35 is also operated by a command from the main control panel 34.

A pair of pressure detectors 32 are mounted at the upper end portion of a chute body 31 of the chute 30 outside a housing 1 of the roller mill and at the lower end portion of the chute body 31 inside the housing 1, respectively, so as to detect different pressures in the upper and lower end portions of the chute body 31. Both the pressure detectors 32 are connected to a differential pressure transmitter 33, which is in turn connected to the main control panel 34.

In the fifth preferred embodiment mentioned above, the compressed air is supplied to each cylinder 38 by the commands from the main control panel 34 to remotely operate each cylinder 38. Accordingly, each push rod 37 is advanced and retracted by the corresponding cylinder 38 to forcibly deform the liner 12 as similar to the third preferred embodiment. Thus, a deposit layer on the inner surface of the liner 12 can be removed away securely and easily.

The roller mill is usually operated in the condition where the inside of the housing 1 is kept under a negative pressure or a positive pressure with respect to an atmospheric pressure. Accordingly, when the deposition of a feed material on the inner surface of the feed inlet chute 30 causes a reduction in sectional area of the passage of the chute 30, there results a difference between the pressures at the upper and lower end portions of the chute body 31. According to this preferred embodiment, the pressure difference between the upper and lower end portions of the chute body 31 is detected by the pressure detectors 32 during the operation of the roller mill, and the difference between the detected pressures is transmitted by the differential pressure transmitter 33 to the main control panel 34. When the pressure difference reaches a preset value, the main control panel 34 generates a command to automatically operate each cylinder 38 and accordingly operate each push rod 37, thus always maintaining a good condition of the chute 30 such that the growth of the deposit layer on the inner surface of the liner 12 is eliminated.

Figure 6:
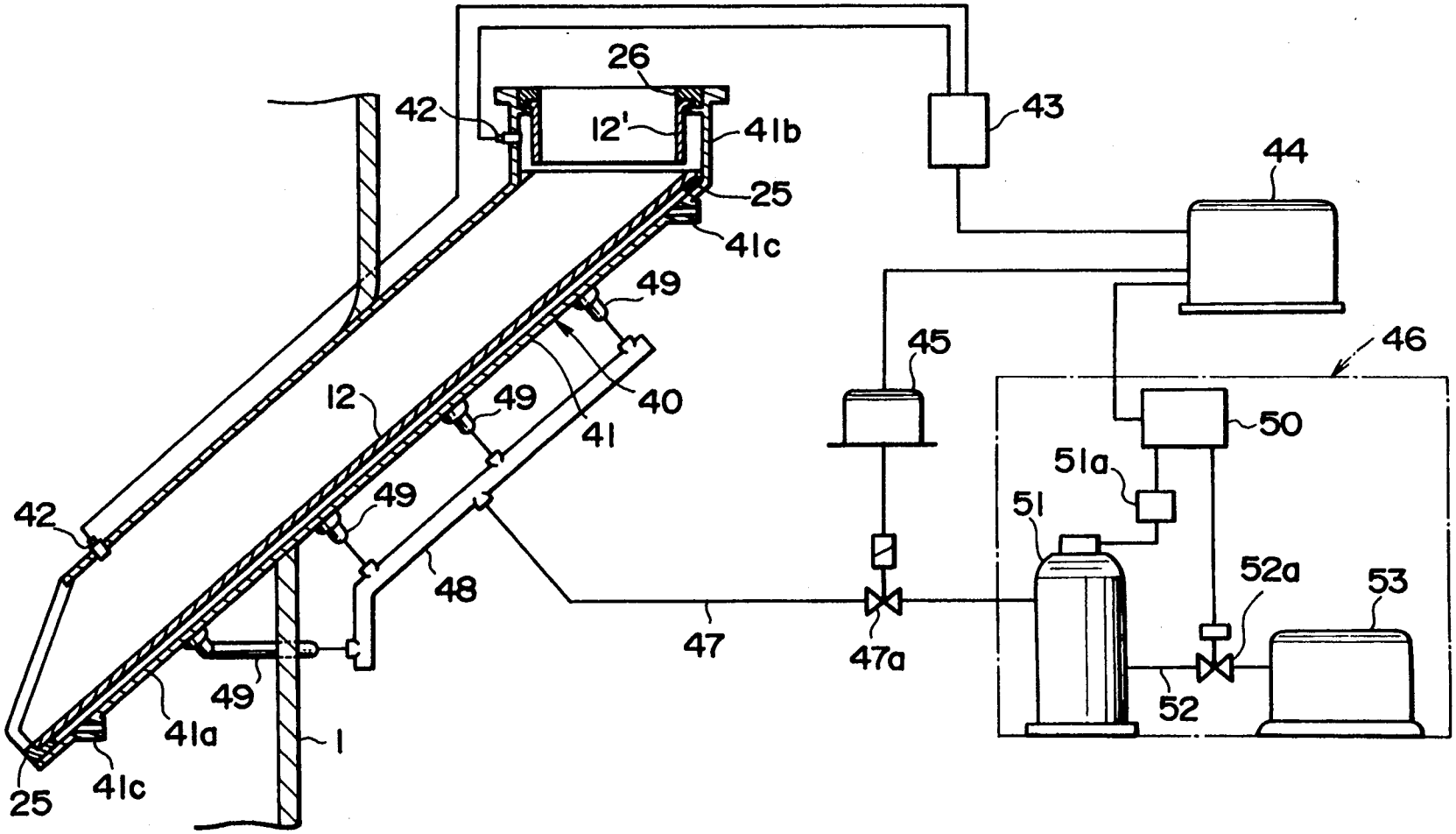
FIG. 6 is a vertical sectional view of an essential part of a roller mill and an operation control system therefor according to a sixth preferred embodiment of the present invention.
Figure 7:
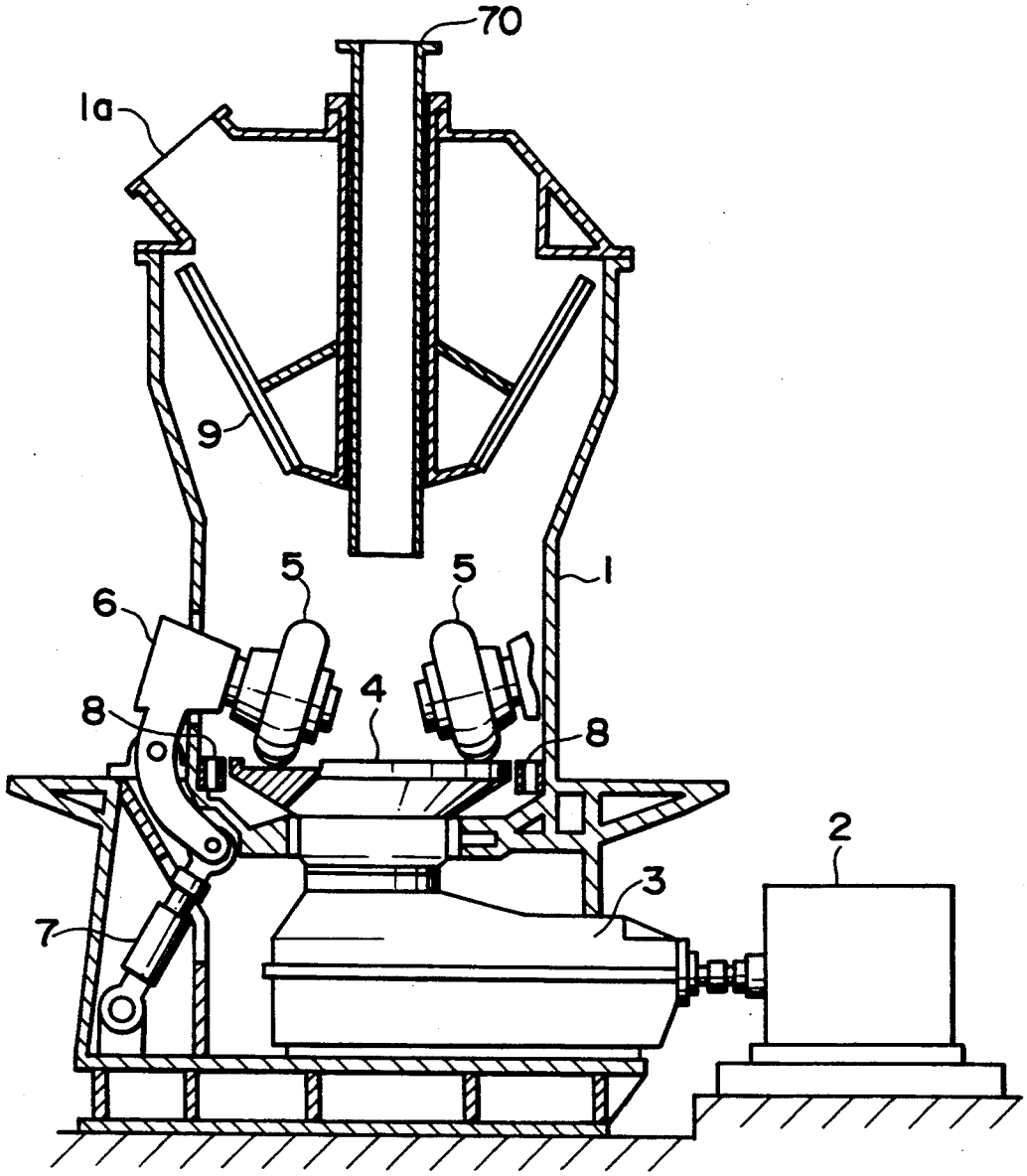
FIG. 7 PRIOR ART
FIG. 7 is a vertical sectional view of a center feed type of roller mill in the prior art.

A sixth preferred embodiment of the present invention will now be described with reference to FIG. 6, which shows an essential part of a roller mill and its operation control system according to the sixth preferred embodiment. The sixth preferred embodiment is similar to the fourth preferred embodiment for the addition of an operation control system for controlling the operation of a feed inlet chute. Therefore, only an essential part primarily including the feed inlet chute and the operation control system is shown in FIG. 6. Further, the parts equivalent to those shown in FIGS. 4A and 4B are denoted by the same reference numerals with the explanation thereof omitted, and only different parts will be essentially described.

Referring to FIG. 6, reference numeral 40 denotes a feed inlet chute having a plurality of air injection pipes 49 similar to those shown in FIGS. 4A and 4B. The air injection pipes 49 are connected through a distributing header 48 and a pipe 47 to a compressed air supply device 46, so that a compressed air supplied from the compressed air supply device 46 is injected to a liner 12. A closing valve **47*a* is provided in the pipe 47. The closing valve 47*a* is intermittently operated by a command from an interval control panel 45**.

The interval control panel 45 is connected to a main control panel 44. The main control panel 44 generates a command for controlling intervals of intermittent operation of the closing valve **47*a*. That is, the closing valve 47*a* is intermittently operated at the intervals based on the command from the main control panel 44 through the interval control panel 45, thereby generating pulsation of the compressed air supplied from the compressed air supply device 46 and feeding a pulsating compressed air thus obtained to each air injection pipe 49**.

The compressed air supply device 46 includes an air reservoir tank 51 with a pressure transmitter **51*a*, a compressor 53 connected through a pipe 52 having a pressure control valve 52*a* to the air reservoir tank 51, and a pressure controller 50 connected to the pressure transmitter 51*a* and the pressure control valve 52*a*. The pressure controller 50 is connected to the main control panel 44. Thus, the pressure of the compressed air to be supplied to each air injection pipe 49 is controlled at a predetermined value by the pressure controller 50 on the basis of a command from the main control panel 44**.

As similar to the fifth preferred embodiment, a pair of pressure detectors 42 are mounted at the upper and lower end portions of a chute body 41 of the chute 40, respectively, so as to detect any pressure difference between the upper and lower end portions of the chute body 41. Both the pressure detectors 42 are connected to a differential pressure transmitter 43, which is in turn connected to the main control panel 44.

In the sixth preferred embodiment mentioned above, the pulsating compressed air is remotely supplied to each air injection pipe 49 by the commands from the main control panel 44, and is injected from each air injection pipe 49 to the liner 12, thereby forcibly deforming the liner 12 as similar to the fourth preferred embodiment. Thus, a deposit layer on the inner surface of the liner 12 can be removed securely and easily. Further, as similar to the fourth preferred embodiment, the air injected from each air injection pipe 49 is expelled from air vents **41*c* formed at the upper and lower portions of an inclined portion 41*a* of the chute body 41 to thereby produce an air flow in the space between the liner 12 and the inclined portion 41*a*, thus cooling the liner 12**.

Further, as similar to the fifth preferred embodiment, the pressure difference in the upper and lower end portions of the chute body 41 is detected by the pressure detectors 42 during the operation of the roller mill, and the difference between the detected pressures is transmitted by the differential pressure transmitter 43 to the main control panel 44. When the pressure difference reaches a preset value, the main control panel 44 generates a command to automatically inject the pulsating compressed air from each air injection pipe 49, thus always maintaining a good condition of the chute 40 such that the growth of the deposit layer on the inner surface of the liner 12 is eliminated.

Moreover, the deformation of the liner 12 is not caused by any mechanical means accompanying a sliding motion in this preferred embodiment, thereby greatly reducing wear or the like of the parts of the roller mill and effecting easy maintenance. An external force generating the deformation of the liner 12 can be continuously adjusted in value by changing the pressure of the compressed air to be supplied, and also can be arbitrarily changed by controlling the intervals of the pulsation of the compressed air. Thus, the external force can be varied widely and immediately in response to a change in characteristics of a feed material.

Although the liners 12 and 12' are formed of a natural or synthetic rubber material in the first to sixth preferred embodiments mentioned above, the material of the liners 12 and 12' is not limited to the above in the present invention. In particular, when there is defined a space between each liner and the chute body as in the second to sixth preferred embodiments, a metal plate or the like having a flexibility and an elasticity may be used for each liner. Also in this case, a similar effect can be obtained.

Further, in the fifth and sixth preferred embodiments, the two pressure detectors are mounted at the upper and lower end portions of the chute body, respectively, and the operation of the push rods and the air injection pipes is controlled according to the difference between the pressures detected by the pressure detectors. However, it is not always necessary to mount the two pressure detectors at the upper and lower end portions. For example, a single pressure detector may be mounted at the upper end portion only of the chute body to detect a change in internal pressure of the chute body, from which the growth of the deposit layer in the chute may be determined. Also in this case, similar operation control can be effected.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A roller mill comprising:

a housing;

a milling table adapted to be rotated about a vertical axis provided in said housing;

a plurality of milling rollers provided in said housing and mounted so as to act against an outer portion of the upper surface of said milling table; and a feed inlet chute extending obliquely through a side wall of said housing for supplying a feed material from outside the housing onto said milling table to be pulverized between said milling table and said milling rollers;

wherein said feed inlet chute comprises a liner made of a flexible elastic material, and a chute body such that said liner is mounted inside said chute body;

wherein said roller mill further comprises liner deforming means for forcibly deforming said liner; and said feed inlet chute further comprises a plurality of spacers mounted between said chute body and said liner to thereby define a space between said liner and said chute body.

2. The roller mill according to claim 1, further comprising pressure detecting means for detecting the pressure in said feed inlet chute; and controlling means for operating said liner deforming means in accordance with the pressure detected by said pressure detecting means.

3. The roller mill according to claim 2, further comprising cooling means for cooling said liner.

4. The roller mill according to claim 2, wherein said liner deforming means comprises a push rod adapted to be pushed against and retracted from said liner and a hydraulic cylinder for operating said push rod wherein said cylinder is controlled by said controlling means in accordance with the pressure detected by said pressure sensors.

5. The roller mill according to claim 2, wherein said liner deforming means comprises a compressed air supply unit and an air injection pipe adapted to inject pulses of compressed air supplied by said air supply unit towards said liner wherein the supply of air from said air supply unit to said injection pipe is controlled by said controlling means in accordance with the pressure detected by the pressure detecting means.

6. The roller mill according to claim 2, wherein said pressure detecting means comprises a first pressure sensor for detecting the pressure at the upper portion of said feed inlet chute and a second pressure sensor for detecting the pressure at the lower portion of said feed inlet chute and wherein the controlling means operates said liner deforming means in accordance with the difference in pressures detected by the first pressure sensor and second pressure sensor.

7. The roller mill according to claim 1, further comprising cooling means for cooling said liner.

8. The roller mill according to claim 1, wherein said liner is detachably connected to said chute body by a fastener.

9. The roller mill according to claim 1, wherein said liner is closely fitted to the inner surface of said chute body.

10. The roller mill according to claim 1, wherein said liner deforming means comprises a push rod adapted to be pushed against and retracted from said liner.

11. The roller mill according to claim 1, wherein said liner deforming means comprises an air injection pipe adapted to inject pulses of compressed air towards said liner.

12. The roller mill according to claim 1, wherein said liner is made from a rubber material.

13. The roller mill according to claim 1, wherein said feed inlet chute further comprises projections on an inner surface of said chute body and wherein said projections contact said liner.

14. A roller mill comprising:

a housing;

a milling table adapted to be rotated about a vertical axis provided in said housing;

a plurality of milling rollers provided in said housing and mounted so as to act against an outer portion of the upper surface of said milling table; and a feed inlet chute extending obliquely through a side wall of said housing for supplying a feed material from outside the housing onto said milling table to be pulverized between said milling table and said milling rollers;

wherein said feet inlet chute comprises:

a liner made of a flexible elastic material;

a chute body such that said liner is mounted inside said chute body; and attachment means at each longitudinal end of said liner for attaching said liner to said chute body, wherein a space is defined between said liner and said chute body which extends substantially over a full length of said liner and said chute body to permit a deformation of said liner within said space as the feed material is supplied through said feed inlet chute for preventing an adherence of the feed material on the liner.

15. The roller mill according to claim 14, wherein said feed inlet chute further comprises a plurality of spacers mounted between said chute body and said liner.

* * * * *